US005429648A

United States Patent [19]

Wu

[11] Patent Number: 5,429,648

[45] Date of Patent: Jul. 4, 1995

[54] PROCESS FOR INDUCING POROSITY IN AN ABRASIVE ARTICLE

[75] Inventor: Mianxue Wu, Worcester, Mass.

[73] Assignee: Norton Company, Worcester, Mass.

[21] Appl. No.: 125,984

[22] Filed: Sep. 23, 1993

[51] Int. Cl.[6] ..... B24D 3/00

[52] U.S. Cl. ..... 51/296; 51/298; 51/306

[58] Field of Search ..... 51/293, 296, 298, 306

[56] References Cited

U.S. PATENT DOCUMENTS

| | | | |
|---|---|---|---|
| 5,102,429 | 4/1992 | Wald et al. | 51/293 |
| 5,160,509 | 11/1992 | Carmen et al. | 51/296 |
| 5,164,348 | 11/1992 | Wood | 51/298 |
| 5,213,591 | 5/1993 | Celikkaya et al. | 51/293 |
| 5,221,294 | 6/1993 | Carman et al. | 51/296 |

FOREIGN PATENT DOCUMENTS

0435677A2 7/1991 European Pat. Off. ..... C04B 35/10

*Primary Examiner*—Deborah Jones

*Attorney, Agent, or Firm*—Stephen L. Borst

[57] ABSTRACT

The invention is a process of manufacturing an abrasive article with the steps of forming an abrasive article in the unfired state comprising an abrasive, a vitreous bond and a polymer resin wherein the polymer resin has an elastic modulus greater than about $2.0\times10^9$ Pa, a weight gain due to moisture absorption when measured after exposure to a 90° C. temperature and 85% relative humidity for 10 hours of less than about 2 wt % and a weight loss on firing in a nitrogen atmosphere at 5° C. per minute to 550° C. of greater than about 95 wt %, and firing the abrasive article thereby decomposing the polymer resin and creating pores in the abrasive article. The invention further includes the abrasive article formed in the unfired state by the above process.

18 Claims, No Drawings

PROCESS FOR INDUCING POROSITY IN AN ABRASIVE ARTICLE

BACKGROUND OF THE INVENTION

1. Field of the Invention

The invention relates to a process for inducing porosity in an abrasive articles by addition of a polymer resin which has lower elasticity, less moisture sensitivity, and improved thermal decomposition to the abrasive articles when forming. The invention further includes an unfired abrasive article comprising the polymer resin, and a pore inducer comprising the polymer resin.

2. Technology Review

Pores in an abrasive tool such as a grinding wheel are important. Pores, especially those which are interconnected in an abrasive tool, play a critical role in providing access to grinding fluids such as coolant to transfer the heat generated during grinding. In addition, pores supply clearance for material (e.g., metal chips) removed from an object being ground. These roles are particularly important in deep cut and modern precision grinding processes (i.e., creep feed grinding) for effectively grinding difficult-to-machine high performance alloys and hardened metals where a large amount of material is removed in one deep grinding pass without sacrificing the accuracy of the workpiece dimension. The porosity often determines the quality of the workpiece (such as metallurgical damage or "burn", and residual stresses), wheel life, cutting efficiency and the grinding power. Therefore, a high-porosity abrasive tool is often desired in many grinding applications.

Porosity is formed by both the natural spacing provided by the natural packing density of the materials and by conventional pore inducing media called "pore inducers" such as for example hollow glass beads, beads of plastic material or organic compounds, ground walnut shells, foamed glass particles and bubble alumina. While these conventional pore inducers provide porosity in the fired abrasive tool, there are drawbacks to their use. These drawbacks include one or more of the following: closed porosity, high springback, high moisture sensitivity, and incomplete thermal decomposition.

Springback is a measurement of the change in dimensions of an abrasive article over time after the release of pressure from molding or forming. The change in dimension of the abrasive tool is to a substantial extent affected by the elastic modulus of the material used as a pore inducer if the pore inducer is present in large enough quantities. Because of springback and its unpredictable nature, the accurate dimensions of a molded abrasive tool are often uncontrollable; therefore, the abrasive tool is off in its specification and properties making the process of producing the abrasive tools difficult to control.

Moisture absorption is the amount of water ($H_2O$) a pore inducer absorbs. High moisture absorption results in inconsistency in a pore inducer used in production of abrasive tools, and the change in water content affects the mixing, forming and firing of the abrasive tool. The humidity changes from day to day or season to season will change the water content of the final abrasive tool composition when a moisture sensitive pore inducer is used. Further, the variable moisture content makes the mixing, forming and firing of the abrasive tool more difficult. In addition, because of the unpredictability of the moisture content, the strength of the unfired wheels also become unpredictable.

Thermal decomposition behavior is the degree of decomposition of the pore inducer. Clean burn-off of the pore inducer below a certain temperature (such as glass transition point, $T_g$, of the vitrified bond, ~500°-600° C.) is desirable. Any residual pore inducer such as ash and/or charred carbon will result in a grinding wheel with "coring" problems, uncompletly induced pores and/or will result in changes in properties. Coring not only creates a "blackening" of the interior and at times the surface of the abrasive tool, it causes differences in properties and performance of the abrasive tool where the residual carbon due to its non-wetting nature with oxides can result in a weaker bond between the abrasive and the bond.

What is desired therefore is to provide a process of manufacturing abrasive tools with polymer resins having low moisture absorption which completely thermally decompose below the glass transition temperature of the vitrified bond, and when incorporated into the abrasive tool result in a tool with low springback and result in an abrasive article with properties similar to those made with conventional pore inducers.

SUMMARY OF THE INVENTION

The present invention is a process of manufacturing an abrasive article with the steps of forming an abrasive article in the unfired state comprising an abrasive, a vitreous bond and a polymer resin wherein the polymer resin has an elastic modulus greater than about $2.0\times10^9$ Pa, a weight gain due to moisture absorption when measured after exposure to a 90° C. temperature and 85% relative humidity for 10 hours of less than about 2 wt % and a weight loss on firing in a nitrogen atmosphere at 5° C. per minute to 550° C. of greater than about 95 wt %, and firing the abrasive article thereby decomposing the polymer resin and creating pores in the abrasive article.

The present invention further includes an abrasive article in the unfired state comprising an abrasive, a vitrified bond and a polymer resin wherein the polymer resin has an elastic modulus greater than about $2.0\times10^9$ Pa, a weight gain due to moisture absorption when measured gain after exposure to a 90° C. temperature and 85% relative humidity for 10 hours of less than about 2 wt % and a weight loss on firing in a nitrogen atmosphere at 5° C. per minute to 550° C. of greater than about 95 wt %.

DETAILED DESCRIPTION OF THE INVENTION

The present invention is a process of manufacturing an abrasive article with the steps of forming an abrasive article in the unfired state comprising an abrasive, a vitreous bond and a polymer resin wherein the polymer resin has an elastic modulus greater than about $2.0\times10^9$ Pa, a weight gain due to moisture absorption when measured after exposure to a 90° C. temperature and 85% relative humidity for 10 hours of less than about 2 wt % and a weight loss on firing in a nitrogen atmosphere at 5° C. per minute to 550° C. of greater than about 95 wt %, and firing the abrasive article thereby decomposing the polymer resin and creating pores in the abrasive article.

The abrasive tool comprises an abrasive, a vitreous bond and a polymer resin with specific properties. One abrasive or a combination of abrasives can be used in the mixture which is used to form the abrasive tool. Examples of abrasives which can be used are fused alumina, silicon carbide, cubic boron nitride, diamond, flint, garnet and seeded and unseeded solgel alumina. These examples of abrasives are given as an illustration and not as a limitation. The abrasives preferably form from about 30 to about 50 volume % of the total volume of the unfired abrasive tool, more preferably from about 35 to about 50 volume % of the total volume of the unfired abrasive tool, and most preferably from about 37 to about 45 volume % of the total volume of the unfired abrasive tool.

The abrasive tools of this invention are bonded with a vitreous bond. Any conventional vitreous bond composition may be used in the present invention. Preferably, however, the glass transition temperature of the vitrified bond composition is above about 500° C., and more preferably above about 600° C. The vitreous bond preferably forms from about 2 to about 20 volume % of the total volume of the unfired abrasive tool, more preferably from about 3 to about 15 volume % of the total volume of the unfired abrasive tool, and most preferably from about 4 to about 12 volume % of the total volume of the unfired abrasive tool.

A polymer resin is used for inducing pores in the abrasive tool upon firing. The polymer resin has an elastic modulus which is generally higher than most polymers indicating that the polymer resin is relatively more brittle than other polymers such as for example polypropylene or polyethylene. The elastic modulus is preferably greater than about $2.0\times10^9$ Pa, preferably greater than about $2.5\times10^9$ Pa, more preferably greater than about $3.0\times10^9$ Pa, and most preferably greater than about $3.5\times10^9$ Pa.

The polymer resin has a low moisture sensitivity which is measured by determining the weight gain due to moisture adsorption of the resin in the particle size range used in the process held at 90° C. and at 85% relative humidity for a period of 10 hours. The weight gain of the polymer resin due to moisture adsorption is preferably less than about 2.0 wt % of the total polymer resin weight, preferably less than about 1.0 wt % of the total polymer resin weight, more preferably less than about 0.5 wt % of the total polymer resin weight, and most preferably less than about 0.1 wt % of the total polymer resin weight.

The polymer resin has a substantially complete thermal decomposition in both air and nitrogen atmospheres. The thermal decomposition behavior of the polymer resin was measured by measuring the amounts of residual ash and/or carbon remaining after firing the polymer resin at 5° C. per minute from room temperature to 550° C. with no holding time in a thermal gravimetric analyzer in both air and nitrogen atmospheres with flow rate of ~200 cc/minute. By determining the amounts of residual ash and/or carbon remaining after firing, the weight loss on firing could be determined by subtracting wt % of residual ash and/or carbon remaining from 100 wt %. The weight loss on firing of the polymer resin in a nitrogen atmosphere at 5° C. per minute to 550° C. is preferably greater than about 95 wt % of the total polymer resin weight, more preferably greater than about 98 wt % of the total polymer resin weight, and most preferably greater than about 99 wt % of the total polymer resin weight. The weight loss on firing of the polymer resin in an air atmosphere at 5° C. per minute to 550° C. is preferably greater than about 95 wt % of the total polymer resin weight, more preferably greater than about 98 wt % of the total polymer resin weight, and most preferably greater than about 99 wt % of the total polymer resin weight.

The polymer resin which is used as a pore inducer preferably is an aliphatic hydrocarbon. More preferably the polymer resin has a high-softening-point, is thermoplastic, has low molecular weight, and is derived from dienes and other reactive olefin monomers. Most preferably the polymer resin is Piccotac® 115 Resin manufactured and sold by Hercules Incorporated with a softening point from 113°–119° C., a specific gravity at 25° C. of 0.957, an acid number less than 1, a flashpoint of 293° C., and a molecular weight where $M_w$ is 3,000, $M_n$ is 1100, and $M_z$ is 10,500. Most preferably the aliphatic hydrocarbon comprises about 60 wt % cis- and transpiperylene, and about 12 wt % 2-methyl-2-butene, about 4 wt % cyclopentane, about 2 wt % cyclopentadiene and about 6 wt % of miscellaneous $C_4/C_5$ resin formers.

The polymer resin used as a pore inducer preferably forms from about 5 to about 25 volume % of the total volume of the unfired abrasive tool, more preferably from about 5 to about 15 volume % of the total volume of the unfired abrasive tool, and most preferably from about 5 to about 10 volume % of the total volume of the unfired abrasive tool.

The abrasive tool can include other additives which are known to those skilled in the art. The mixture comprising the abrasive(s), vitreous bond and polymer resin used as a pore inducer is then mixed using conventional mixers and formed.

The abrasive tool can be formed by any cold forming processes known to those skilled in the art. Cold forming processes are any processes which leave the resulting shaped abrasive tool in an unfired or unsintered state. Examples of cold forming processes are cold pressing, extrusion, injection molding, cold isostatic pressing and slip casting. These examples are given, however, as an illustration and not as a limitation.

The abrasive tool then can be fired by conventional firing processes which are dependent on the amount and type of the bond and the amount and type of the abrasive. Preferably the fired abrasive tool has a porosity of from about 35 to about 65 volume % of the abrasive tool, more preferably from about 40 to about 60 volume % of the abrasive tool, and most preferably from about 45 to about 55 volume % of the abrasive tool.

In order that persons in the art may better understand the practice of the present invention, the following Examples are provided by way of illustration, and not by way of limitation. Additional background information known in the art may be found in the references and patents cited herein, which are hereby incorporated by reference.

EXAMPLES

EXAMPLE 1

This Example demonstrates the difference in springback between using the aliphatic hydrocarbon Piccotac® 115 and using a standard pore inducer such as a walnut shell. Disks were formed using the aliphatic hydrocarbon Piccotac 115 and walnut shells with the following composition shown in Table I:

TABLE I

| | Parts by Weight |
|---|---|
| Composition of raw material ingredients for walnut shell based disk: | |
| Alumina abrasive 80 grit (38A80) | 100 |
| Walnut shells(150–250 um particle size) | 7.92 |
| Dextrin | 1.75 |
| Animal glue | 5.03 |
| Ethylene glycol | 0.30 |
| Vitrified bond material | 9.91 |
| Bulking agent (Vinsol ® powder) | 0.75 |
| Composition of raw material ingredients for aliphatic hydrocarbon Piccotac ® 115 based disk: | |
| Alumina abrasive 80 grit (38A80) | 100 |
| Piccotac ® 115(150–250 um particle size) | 5.83 |
| Dextrin | 1.75 |
| Animal glue | 3.52 |
| Ethylene glycol | 0.30 |
| Vitrified bond material | 9.91 |
| Bulking agent (Vinsol ® powder) | 0.75 |

The raw materials for the disks were weighed and mixed in a Hobart ® mixer according to the composition and sequence described above. Each ingredient was added sequentially and was mixed with the previously added ingredients for about 1–2 minutes after each addition. After mixing, the mixture was screened through a 20 mesh screen to assure no agglomeration of the mixture. The mixed material was then placed into a 3 inch diameter steel mold and was manually cold pressed in a hydraulic molding press under 10 tons pressure for 10 seconds resulting in a 2 inch thick disk. After the pressure was removed from the pressed disks, measurements were made determining the change in thickness of the unfired disk over time. Springback of the unfired disk was calculated based on the thickness change relative to the original thickness. The values of springback for both types of disks were the averages of three wheels molded with each individual disk being measured at three points for a wheel average. The results demonstrate lower springback over using walnut shells, see Table II.

TABLE II

| | Time after Molding (min) | | | | |
|---|---|---|---|---|---|
| Pore Inducer Used | 0.5 | 5 | 60 | 300 | 600 |
| (1) walnut shell | 4.6% | | 5.7% | | 5.6% |
| (2) Piccotac ® 115 | 0.30% | 0.33% | 0.32% | 0.32% | |

EXAMPLE 2

This Example demonstrates the lower moisture sensitivity of the aliphatic hydrocarbon Piccotac ® 115. The aliphatic hydrocarbon Piccotac ® 115 resin has virtually has no moisture adsorption. Samples (5 grams with a particle size of 150–250 um) of walnut shells, activated carbon and aliphatic hydrocarbon Piccotac ® 115 were subjected to conditions of 90° C. and 85% relative humidity for 10 hours in a humidity controlled chamber made by Tenney Engineering, Inc. of Union, N.J. The weight gain due to moisture adsorption of the aliphatic hydrocarbon Piccotac ® 115 resin was negligible while a standard pore inducer walnut shell had a weight gain 3.8% and another pore inducer, activated carbon had 29% weight gain under the same conditions. When the pore inducer aliphatic hydrocarbon Piccotac ® 115 was introduced in an unfired disk which weighed 420 grams, with dimensions of 3 inches in diameter and 2 inches in thickness made from the composition and by the process as described in Example 1, the total weight gain was only 0.22%.

EXAMPLE 3

This Example demonstrates the aliphatic hydrocarbon Piccotac ® 115's thermal decomposition behavior. Piccotac ® 115 as well as two other pore inducers (walnut shells and activated carbon) were tested using a thermal gravimetric analyzer made by Seiko Instruments, model number TGA/DTA RTG 220. The pore inducers were all tested under the following conditions. The following table lists three pore inducers for comparison of their residual ash amounts after thermally decomposing the pore inducers in both an air atmosphere and a nitrogen atmosphere, the tests were conducted by heating the pore inducers at 5° C./min to 550° C. with no holding time in a thermal gravimetric analyzer with a gas flow rate of approximately 200 cc/minute. This test was performed to simulate the furnace conditions of oxygen-richer atmosphere for the near-surface regions and oxygen-poorer atmosphere for interior regions of the abrasive tool. The results show that the Piccotac ® 115 resin can be burned off relatively cleanly, see Table III:

TABLE III

| Pore Inducer Type | Air Atmosphere Residual Ash (wt %) | $N_2$ Atmosphere Residual Ash (wt %) |
|---|---|---|
| Walnut Shell | ~1% | ~25% |
| Activated Carbon | ~50% | ~95% |
| Aliphatic Hydrocarbon (Piccotac ® 115) | ~1% | ~0% |

Among the three pore inducers, the aliphatic hydrocarbon Piccotac ® 115 demonstrates the most complete thermal decomposition in both types of atmospheres.

EXAMPLE 4

This example illustrates the production of a high-porosity grinding wheel using an aliphatic hydrocarbon such as Piccotac ® 115 as a pore inducer in the unfired state, followed by firing the wheel to burn off the pore inducer to form the abrasive wheel.

A standard wheel (Norton's 38A60/1-F16-VCF2) for creepfeed grinding applications was made according to the following formula (weight ratio) in Table IV:

TABLE IV

| | Parts by Weight |
|---|---|
| Alumina abrasive 60 grit (38A60) | 100 |
| Walnut shells | 4.50 |
| Dextrin | 2.00 |
| Animal glue (AR30) | 4.14 |
| Bulking agent (Vinsol ® powder) | 2.00 |
| Ethylene glycol | 0.10 |
| Vitrified bond material | 8.07 |

A product using the aliphatic hydrocarbon Piccotac ® 115 to replace walnut shells (equivalent volume) was created at the same fired density and total porosity of a wheel with walnut shells and was made according to the following formula (weight ratio) in Table V:

TABLE V

| | Parts by Weight |
|---|---|
| Alumina abrasive 60 grit (38A60) | 100 |
| Aliphatic hydrocarbon (Piccotac ® 115) | 3.31 |
| Dextrin | 2.00 |

TABLE V-continued

| | Parts by Weight |
|---|---|
| Animal glue (ZW) | 2.90 |
| Bulking agent (Vinsol ® powder) | 2.00 |
| Ethylene glycol | 0.10 |
| Vitrified bond material | 8.07 |

Both wheels were batched, mixed and molded, dried for 2 days at 35% relative humidity and 43° C., followed by a standard firing procedure at 1250° C. for 8 hours in a tunnel kiln. The fired wheels had 42 volume % abrasive, 5.2 volume vitrified bond and 52.8 volume % total porosity. The properties of the wheels were measured, see in Table VI:

TABLE VI

| Pore Inducer | Fired Density (g/cc) | Elastic Modulus (GPa) | Air Permeability (cc/sec/in.$H_2O$) |
|---|---|---|---|
| Walnut Shells | 1.795 | 21.8 | 28.14 |
| Aliphatic hyd. | 1.785 | 21.6 | 30.94 |

The grinding test was performed on a Blohm ® grinder using a non-continuous dress creepfeed mode on 4340 steel. The test showed similar performance between the wheels made with walnut shells and those made with the aliphatic hydrocarbon Piccotac ® 115: the average grindability indexes of these two were 1.36 and 1.24 ($in^2$.min/$in^3$.HP), respectively, over a wide metal removal rate range.

EXAMPLE 5

This example illustrates the production of a high-porosity grinding wheel using various sizes of the aliphatic hydrocarbon Piccotac ® 115 as a pore inducer in the unfired state, followed by firing of the wheel to burn off the pore inducer to form the abrasive wheel with improved grinding performance.

Three wheels were made using the aliphatic hydrocarbon Piccotac ® 115 with particle sizes between 150–250 um (mesh size −60/+100 or "size 6"), 250–425 um (mesh size −40/+60 or "size 5") and 600–850 um (mesh size −20/+30 or "size 3") to create the same fired density and total porosity for each of the wheels and were made according to the following formula (weight ratio) in Table VII:

TABLE VII

| | Parts by Weight |
|---|---|
| Alumina abrasive 60 grit (38A60) | 100 |
| Aliphatic hydrocarbon (Piccotac ® 115) | 3.31 |
| Dextrin | 2.00 |
| Animal glue | 2.90 |
| Bulking agent (Vinsol ® powder) | 2.00 |
| Ethylene glycol | 0.10 |
| Vitrified bond material | 8.07 |

These wheels were batched, mixed and molded, dried for 2 days at 35% relative humidity and 43° C. followed by a standard firing procedure at 1250° C. for 8 hours in a tunnel kiln. The fired wheels had 42 volume % abrasive, 5.2 volume % vitrified bond and 52.8 volume % total porosity. The properties of these wheels were measured as follows in Table VIII:

TABLE VIII

| Pore Inducer | Fired Density (g/cc) | Elastic Modulus (Gpa) | Air Permeability (cc/sec/in.$H_2O$) |
|---|---|---|---|
| Piccotac ® ("6") | 1.77 | 19.8 | 2.53 |
| Piccotac ® ("5") | 1.78 | 20.1 | 2.20 |
| Piccotac ® ("3") | 1.77 | 20.3 | 2.20 |

The grinding test, using plunge surface grinding wet mode on 4340 steel with a hardness $R_c$=50–53 ground on a surface grinder by Brown & Sharp, showed that when the size of aliphatic hydrocarbon Piccotac ® 115 increased, the G-ratios of the grinding wheel increased while drawing similar power, which resulted in the average grindability indexes of these three of 1.46, 1.84, and 2.22 ($in^2$.min/$in^3$.HP), respectively. This demonstrated that the grinding performance could be optimized by adjusting the size of aliphatic hydrocarbon Piccotac ® 115 resin.

EXAMPLE 6

This example illustrates the use of the polymer resin pore inducer materials to obtain a product with very open/interconnected structure according to the invention.

A standard wheel (Norton's 5SGJ120/3-F28-VCF3) for creepfeed grinding applications was made according to the following formula (weight ratio) in Table IX:

TABLE IX

| | Parts by Weight |
|---|---|
| Abrasives | 100 |
| Sol-gel alumina 120 grit (SGJ120) | 50 |
| Alumina 80 grit (38A80) | 28.9 |
| Bubble alumina 80 grit | 21.1 |
| Walnut shells | 2.8 |
| Dextrin | 2.7 |
| Animal glue | 3.9 |
| Ethylene glycol | 0.22 |
| Vitrified bond material | 20.4 |

A product using the aliphatic hydrocarbon Piccotac ® 115 to create open/interconnected porosity was made according to the following formula in Table X:

TABLE X

| | Parts by Weight |
|---|---|
| Abrasives | 100 |
| Sol-gel alumina 120 grit (SGJ120) | 50 |
| Alumina 80 grit (38A80) | 50 |
| Bubble alumina | 0 |
| Aliphatic Hydrocarbon (Piccotac ® 115) | 6.11 |
| Dextrin | 2.7 |
| Animal glue | 3.8 |
| Ethylene glycol | 0.22 |
| Vitrified bond material | 20.4 |

Both wheels were batched, mixed and molded, dried for 2 days at 35% relative humidity and 43° C., followed by a standard firing procedure at 900° C. for 8 hours. The fired wheels had 36 volume % abrasive, 10.26 volume % vitrified bond and 53.74 volume % total porosity. The properties of these wheels were measured as follows in Table XI:

TABLE XI

| Pore Inducer | Fired Density (g/cc) | Elastic Modulus (GPa) | Air Permeability (cc/sec/in.$H_2O$) |
|---|---|---|---|
| Walnut Shells | 1.67 | 23.9 | 16.96 |
| Aliphatic hyd. | 1.68 | 22.5 | 30.62 |

In grinding tests using a non-continuous dress mode on 4340 steel and tough-to-grind Inconel 718 alloy, the wheels with the aliphatic hydrocarbon Piccotac® 115 showed improvements over the standard walnut shell pore inducer. The wheel with the aliphatic hydrocarbon Piccotac® 115 showed greatly improved surface quality of the ground workpiece and it was found that the wheel can be used at a higher metal removal rate: burn of metal only occurred at a workpiece table speed of 25 inch per minute on 4340 steel and 12.5 inch per minutes on Inconel 718 alloy, compared to the wheel made with the walnut shells which burned the metal at 20 and 7.5 inch per minute, respectively, on the same metals.

The wheel made with the aliphatic hydrocarbon Piccotac 115 also showed greatly enhanced the G-ratios at similar metal removal rates, resulting in an higher average Grindability Index (G-ratio divided by specific energy of grinding) of 2.43 ($in^2$.min/$in^3$.HP), compared to the wheel made with walnut shells which had an average grindability index of 1.50 ($in^2$.min/$in^3$.HP).

It is understood that various other modifications will be apparent to and can be readily made by those skilled in the art without departing from the scope and spirit of the present invention. Accordingly, it is not intended that the scope of the claims appended hereto be limited to the description set forth above but rather that the claims be construed as encompassing all of the features of patentable novelty which reside in the present invention, including all features which would be treated as equivalents thereof by those skilled in the art to which the invention pertains.

What is claimed is:

1. A process of manufacturing an abrasive article comprising the steps of:

A) forming an unfired article comprising a polymer resin, a vitreous bond and an abrasive wherein the polymer resin has an elastic modulus greater than about $2.0\times10^9$ Pa, a weight gain due to moisture absorption when measured after exposure to a 90° C. temperature and 85% relative humidity for 10 hours of less than about 2 wt % and a weight loss on firing in a nitrogen atmosphere at 5° C. per minute to 550° C. of greater than about 95 wt %, and B) firing said unfired article thereby decomposing the polymer resin and forming a porous abrasive article.

2. The process in claim 1, wherein the polymer resin is an aliphatic hydrocarbon.

3. The process in claim 2, wherein the aliphatic hydrocarbon has a softening point from about 113° to about 119° C. a specific gravity at 25° C. of about 0.957, an acid number less than 1, flashpoint of about 293° C., and a molecular weight where $M_w$ is about 3,000, $M_n$ is about 1100, and $M_z$ is about 10,500.

4. The process in claim 2, wherein the aliphatic hydrocarbon comprises about 60 wt % cis- and trans-piperylene, about 16 wt % cyclopentene, about 12 wt % 2-methyl-2-butene, about 4 wt % cyclopentane, about 2 wt % cyclopentadiene and about 6 wt % of miscellaneous $C_4/C_5$ resin formers.

5. The process in claim 1, wherein the polymer resin has an elastic modulus greater than about $2.5\times10^9$ Pa.

6. The process in claim 1, wherein the polymer resin has a weight gain due to moisture absorption when measured after exposure to a 90° C. temperature and 85% relative humidity for 10 hours of less than about 1 wt %.

7. The process in claim 1, wherein the polymer resin has a weight loss on firing in a nitrogen atmosphere at 5° C. per minute to 550° C. of greater than about 98 wt %.

8. The process in claim 1, wherein the polymer resin has a weight loss on firing in an air atmosphere at 5° C. per minute to 550° C. of greater than about 95 wt %.

9. The process in claim 1, wherein the pores form from about 35 to about 65 volume % of the fired abrasive article.

10. An unfired article comprising an abrasive, a vitrified bond and a pore inducing polymer resin wherein the polymer resin has an elastic modulus greater than about $2.0\times10^9$ Pa, a weight gain due to moisture absorption when measured after exposure to a 90° C. temperature and 85% relative humidity for 10 hours of less than about 2 wt % and a weight loss on firing in a nitrogen atmosphere at 5° C. per minute to 550° C. of greater than about 95 wt %.

11. The article in claim 10, containing from about 5 to about 25 volume % of the polymer resin.

12. The article in claim 10, wherein the polymer resin is an aliphatic hydrocarbon.

13. The article in claim 12, wherein the aliphatic hydrocarbon has a softening point from about 113° to about 119° C., a specific gravity, at 25° C. of about 0.957, an acid number less than 1 a flashpoint of about 293° C. and a molecular weight where $M_w$ is about 3,000, $M_n$ is about 1100, and $M_z$ is about 10,500.

14. The article in claim 12, wherein the aliphatic hydrocarbon comprises about 60 wt % cis- and trans-piperylene, about 16 wt % cyclopentene, about 12 wt % 2-methyl-2-butene, about 4 wt % cyclopentane, about 2 wt % cyclopentadiene and about 6 wt % of miscellaneous $C_4/C_5$ resin formers.

15. The article in claim 10, wherein the polymer resin has an elastic modulus greater than about $2.5\times10^9$ Pa.

16. The article in claim 10, wherein the polymer resin has a weight gain due to moisture absorption when measured after exposure to a 90° C. temperature and 85% relative humidity for 10 hours of less than about 1 wt %.

17. The article in claim 10, wherein the polymer resin has a weight loss on firing in a nitrogen atmosphere at 5° C. per minute to 550° C. of greater than about 98 wt %.

18. The article in claim 10, wherein the polymer resin has a weight loss on firing in an air atmosphere at 5° C. per minute to 550° C. of greater than about 95 wt %.

* * * * *